US008414377B1

(12) United States Patent
White

(10) Patent No.: US 8,414,377 B1
(45) **Date of Patent: *Apr. 9, 2013**

(54) METHOD AND APPARATUS FOR A WAGERING GAME WITH INDICIA DEVELOPED PAYLINES

(75) Inventor: Michael L. White, Glenview, IL (US)

(73) Assignee: Primo Innovo, LLC, Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/486,542

(22) Filed: Jun. 1, 2012

Related U.S. Application Data

(63) Continuation-in-part of application No. 12/221,909, filed on Aug. 7, 2008, now Pat. No. 8,287,363.

(51) Int. Cl.
*A63F 9/24* (2006.01)

(52) U.S. Cl.
USPC ..... 463/16; 462/10; 462/17; 462/18; 462/20; 462/22

(58) Field of Classification Search ..... 463/16, 463/10, 17–22
See application file for complete search history.

(56) References Cited

U.S. PATENT DOCUMENTS

| | | | | |
|---|---|---|---|---|
| 5,931,467 | A * | 8/1999 | Kamille | 273/139 |
| 6,089,977 | A * | 7/2000 | Bennett | 463/20 |
| 6,290,600 | B1 * | 9/2001 | Glasson | 463/20 |
| 6,561,900 | B1 * | 5/2003 | Baerlocher et al. | 463/20 |
| 7,419,431 | B2 * | 9/2008 | Gauselmann et al. | 463/30 |
| 2003/0190948 | A1 * | 10/2003 | Baerlocher et al. | 463/20 |
| 2004/0166929 | A1 * | 8/2004 | Tarantino | 463/22 |
| 2005/0255903 | A1 * | 11/2005 | Jackson | 463/16 |
| 2008/0045321 | A1 * | 2/2008 | Kato | 463/20 |
| 2009/0156295 | A1 * | 6/2009 | Demsetz et al. | 463/20 |

* cited by examiner

*Primary Examiner* — Tramar Harper
(74) *Attorney, Agent, or Firm* — Michael L. White

(57) ABSTRACT

In contrast to slot-type gaming machines with their preset paylines designating predetermined array positions, the paylines of this novel wagering game are unknown until the indicia in the array have been selected. The indicia are selected from a variety of indicium types, each having a different number of members for identifying adjacent indicia. The randomly selected indicia determine the paylines, if any, in the array. Conditions may be imposed that limit the size and geometry of the paylines in this wagering game.

19 Claims, 15 Drawing Sheets

600

| PAY TABLE | |
|---|---|
| WINNING SYMBOL COMBINATIONS ANY INDICIA ORIENTATION 610 | INDICIA PAYLINE PAYS 620 |
|  | 10 |
|  | 10 |
|  | 5 |
|  | 3 |
|  | 5 |
|  | 2 |
|  | 1 |

1000

PAY TABLE

| WINNING SYMBOL COMBINATIONS 1010 | INDICIA PAYLINE PAYS 1020 | PRESET PAYLINE PAYS 1030 | |
|---|---|---|---|
| | | SAME ANGLE 1032 | DIFFERENT ANGLES 1034 |
| | 5 | 3 | 1 |
| | 10 | N/A | N/A |
| | 5 | N/A | N/A |
| | 3 | 5 | 2 |
| | 5 | N/A | N/A |
| | 2 | 5 | 3 |
| | 1 | 5 | N/A |
| | N/A | 10 | N/A |

*FIG. 10*

| INDICIA PROBABILITY TABLE | |
|---|---|
| RANDOM NUMBER 1210 | CORRESPONDING INDICIA 1220 |
| 00 |  |
| 01 |  |
| 02 |  |
| 03 |  |
| 04 |  |
| 05 |  |
| 06 |  |
| 07 |  |
| 08 |  |
| 09 |  |
| 10 |  |

1300

| ANGULAR CHANGE PROBABILITY TABLE | |
|---|---|
| RANDOM NUMBER 1310 | ANGULAR CHANGE (DEGREES) 1320 |
| 00 | 0 |
| 01 | 90 |
| 02 | 180 |
| 03 | 270 |

*FIG. 13*

METHOD AND APPARATUS FOR A WAGERING GAME WITH INDICIA DEVELOPED PAYLINES

The present application is a continuation-in-part of U.S. patent application Ser. No. 12/221,909, entitled "Method and Apparatus for a Wagering Game with Indicia Developed Paylines" filed on Aug. 7, 2008, which is hereby incorporated by reference in its entirety, and which issued as U.S. Pat. No. 8,287,363 on Oct. 16, 2012.

FIELD OF THE INVENTION

This invention relates to gaming, and more particularly, in one embodiment, to wagering games played on video gaming machines.

BACKGROUND OF THE INVENTION

Gaming machines are a popular form of entertainment with gaming establishment patrons. Slot type gaming machines form an array of randomly selected indicia. These games traditionally use preset paylines to indicate predetermined array positions, which, if filled with winning combinations of indicia, provide a winning game outcome.

SUMMARY OF THE INVENTION

In one embodiment, the wagering game may be broadly described as a slot type wagering game with indicia developed paylines. A wagering game with an array of randomly selected indicia is presented to the player after a wager is placed. Each indicium in the array has a randomly determined angular orientation and a randomly determined number of members for indicating linkage to adjacent indicia. In one embodiment, when the member of one indicium is in alignment with the member of another indicium, a link is formed between those indicia. Several indicia may link together forming a payline. A winning game outcome occurs when the indicia forming the payline satisfies predetermined requirements.

BRIEF DESCRIPTION OF THE FIGURES

Various embodiments of the wagering game are described and illustrated in the accompanying figures. The figures are provided as examples only and are not intended to be considered as limitations to the invention. Similarly, numerical entries only represent exemplary information, and those skilled in the art understand that a variety of different values and alternate arrangements can be made. Consequently, the wagering game is illustrated by way of example and not by limitation in the accompanying figures in which:

FIG. 10 is an exemplary pay table for the exemplary wagering game embodiment of FIG. 9;

FIG. 13 is an exemplary angular change probability table for randomly determining the change in angular orientation of an indicium in an array position in one embodiment of the wagering game.

DETAILED DESCRIPTION

The wagering game described in the following embodiments may be adapted for play on gaming machines similar to those found in gaming establishments. Gaming establishments commonly network gaming machines into a gaming system to facilitate the monitoring and support of each gaming machine in the system.

Figure 1:
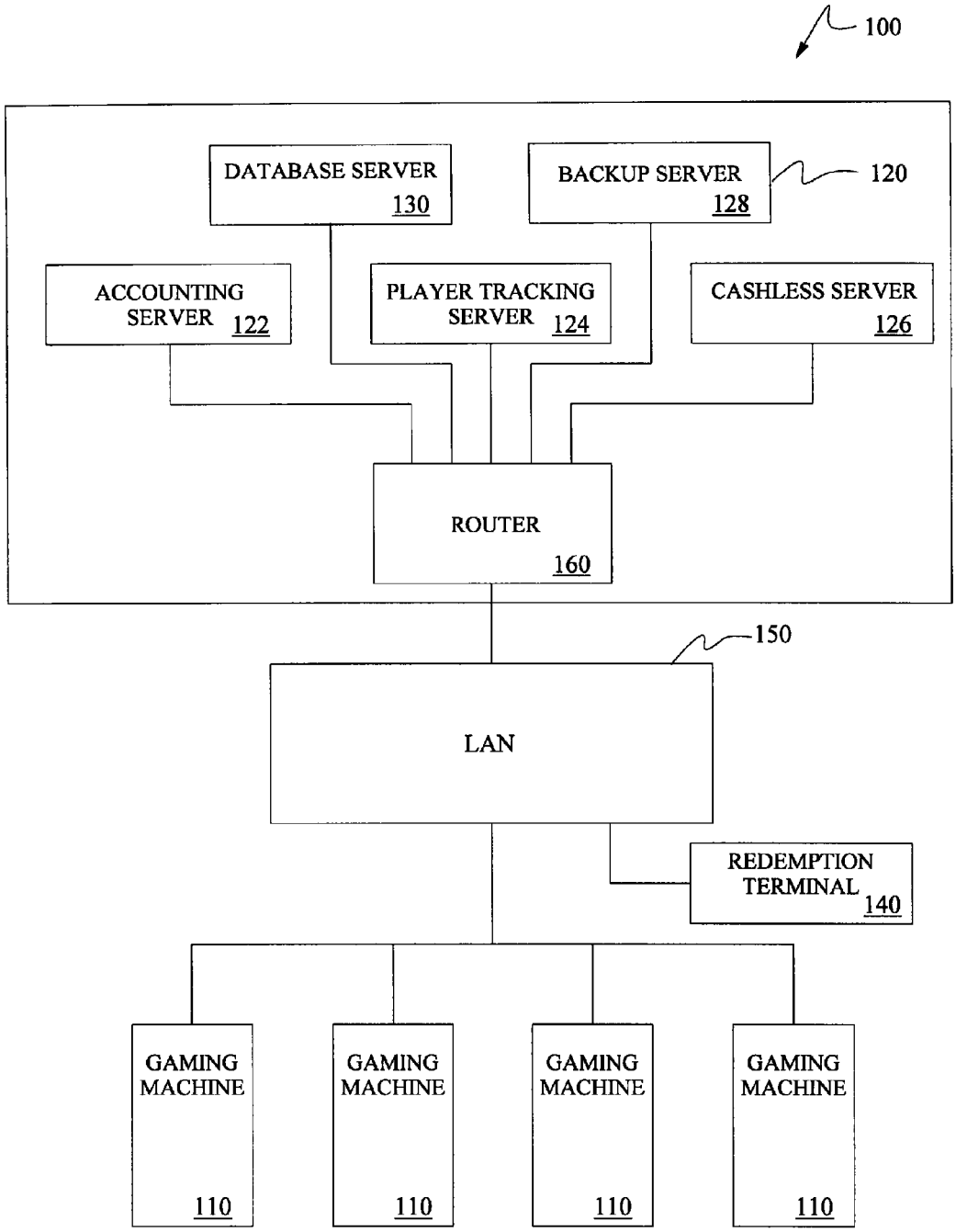
FIG. 1 is an exemplary block diagram of a gaming system.

Referring to FIG. 1, an exemplary gaming system 100 typically found in a gaming establishment is illustrated. Gaming machines 110 on the floor of a gaming establishment are usually in communication with a number of servers 120 that provide ancillary support services for wagering activity at each gaming machine. Other network devices such as routers 160, storage devices (e.g., a database server 130), and backup servers 128 may also be part of the gaming system 100.

These servers 120, and the gaming machines 110 they communicate with, are connected in a communications network (e.g., a local area network (LAN) 150) electronically linking the gaming system 100 together. Although it is common practice to use several different servers, each dedicated to specific gaming functions, it is also possible to bundle these different gaming functions for execution on a single server. Servers 120 commonly found in some gaming systems include an accounting server 122 (to record wagers and payouts), a player-tracking server 124 (to track wagering activity of individual players), and a cashless server 126 (to assist with the issue and redemption of wagering vouchers).

The player-tracking server maintains a record of the player's wagering activity, allowing the gaming establishment to reward gaming patrons with comps commensurate with their wagering activity. A player-tracking card is commonly provided to gaming patrons for participation in player loyalty programs sponsored by the gaming establishment. The player-tracking card is encoded with a unique player identification number that allows the player-tracking server to maintain a record of player wagering activity.

The cashless server maintains a record of issued vouchers. Vouchers are typically paper tickets with an imprinted monetary value that facilitates wagering. These vouchers are printed and accepted by gaming machines 110, allowing players to make wagers and cash out of the gaming machine. Each wagering voucher has a unique barcode identifier acting as an index into a database for retrieving information specific to the voucher (e.g., the monetary value of the voucher). Typically, the cashless server 126 stores this information in a database for recall when the voucher is presented for redemption.

When presented to a gaming machine 110, the barcode information is communicated to the cashless server 126, and the voucher is validated by the cashless server 126. The voucher value is then communicated to the gaming machine, and the value of the voucher credited for play on the gaming machine.

Other gaming related devices in the gaming system 100 may be present and in communication with the local area network 150. For example, a redemption terminal 140 (e.g., such as a computer terminal for a cashier or a self serve kiosk) may be available to allow a player to cash out a voucher. This redemption terminal 140 is typically in communication with the cashless server 126 to facilitate monetary transactions.

The gaming machines 110, servers 120, and other network devices typically use serial communication protocols for transferring data over the gaming system's local area network 150. In other embodiments, gaming systems 100 may use Ethernet type communication protocols or any other communication protocol using any number of different types of communication media (including, e.g., optical fiber, radiofrequency, etc.).

Regardless of whether a single or multiple servers 120 are utilized in the gaming system 100 embodiment illustrated in FIG. 1, in most gaming systems, the gaming machine 110 determines the game outcome and the servers 120 support the wagering and data collection activities of each gaming machine. A game program (i.e., software) controls the gaming machine 110 and is executed with a CPU (i.e., central processing unit or simply processor) in the gaming machine to determine the game outcome.

In other gaming systems, in lieu of executing a game program from a CPU in the gaming machine, the execution of the game program is performed by a CPU in a game server (not shown). For example, in one embodiment, the game server may execute a game program in response to initiation of the wagering game at a gaming machine 110. In this gaming system embodiment, the game server may perform all game program calculations and transmit video data to the gaming machine for display. Player selections may be transmitted from the gaming machine to the gaming server for further execution by the game program.

Alternatively, in still another gaming system embodiment, a CPU in the gaming machine and a CPU in a game server may each execute portions of a game program. For example, the game server may be limited to determining and transmitting random numbers to the gaming machine. The gaming machine uses these random numbers to determine, either directly or indirectly, game outcomes.

The gaming machine 110 illustrated in FIG. 1 is typically either an electro-mechanical gaming machine or a video gaming machine. The electro-mechanical gaming machine has mechanical reels to display game outcomes. In contrast, the video gaming machine has a video display for displaying game outcomes. With the exception of the game presentation (i.e., either mechanical reels or a video display), both types of gaming machines operate using the same basic principles.

Video gaming machines, because of their video display, are adaptable to support many different types of wagering games; including the wagering game described and claimed in this specification. The electromechanical gaming machine may also be adapted to support embodiments of this wagering game. In particular, electromechanical gaming machines using independent reels to individually display each indicium in the array are particularly adaptable.

Figure 2:
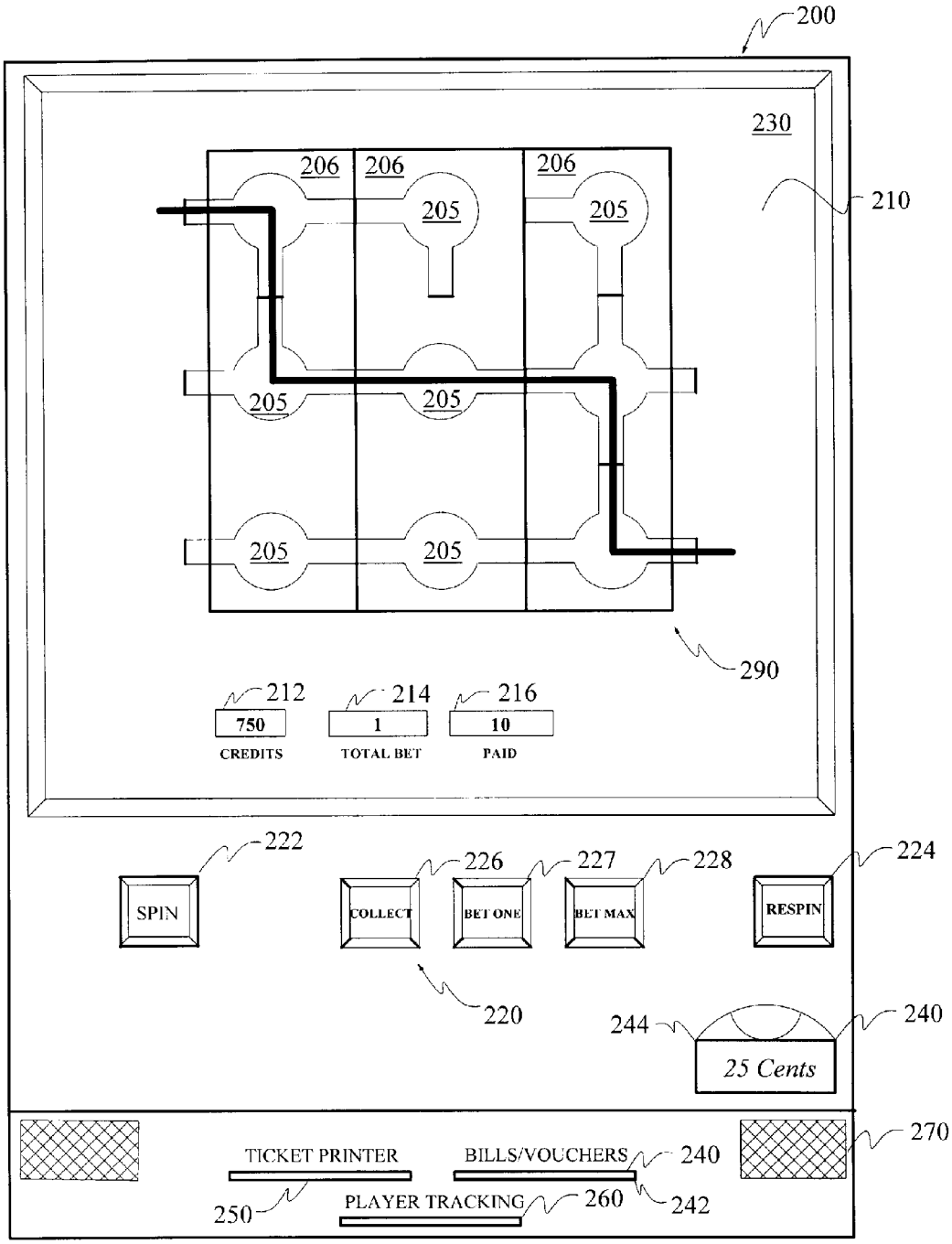
FIG. 2 is an orthogonal view of one embodiment of the gaming machine illustrated in FIG. 1.

FIG. 2 illustrates one embodiment of the gaming machine 110 depicted in FIG. 1. FIG. 2 depicts a video gaming machine 200 specifically adapted for play of the wagering game embodiments described herein. The video gaming machine 200 has a wager acceptor 240 for initiating game play. The wager acceptor 240 may be a bill validator 242 (for accepting paper currency), a coin acceptor 244, or any other device capable of receiving and registering some form of acceptable monetary value. The bill validator 242 may, in some embodiments, also accept vouchers (generally in the form of paper tickets).

As discussed above, vouchers are printed by some video gaming machines 200 in lieu of paying coins when a player cashes out of the gaming machine. The video gaming machine 200, in this embodiment, has a ticket printer 250 which prints a voucher for the value of the cash out from the gaming machine. Typically, the voucher may be redeemed by a video gaming machine 200 by inserting the voucher into the bill validator 242. The bill validator 242 reads the barcode printed on the voucher, communicates with the cashless server to determine the value of the voucher, and credits the video gaming machine 200 for the value of the voucher.

The video gaming machine 200, in some embodiments, may have an alternative or an additional payout mechanism such as a coin hopper (not shown on FIG. 2) internal to the gaming machine. The coin hopper dispenses coins to the player when the player cashes out.

The video gaming machine 200 may also include a card reader 260 for reading the player-tracking card discussed above. The card reader 260 reads the player-tracking card and communicates the player's identification number to a player-tracking server.

Game play is initiated when the video gaming machine 200 receives a wager. The wagering game 290, in one embodiment, is displayed on the video display 210 of the video gaming machine 200. The video display 210 is generally a CRT or flat-panel display such as a LED or plasma display. However, any other type of display may be used to present the wagering game 290.

In one embodiment, the development of the array for the wagering game 290 commences with the spinning of the indicia carriers 206 (i.e., reels), either a mechanical reel or a video representation of a reel, to suggest the random selection of an indicium 205 for each array position. In one embodiment, each of the indicia 205 on the reels 206 may also be changing angular orientation as the reel spins. Consequently, in this embodiment, not only does the reel initially spin, but also the indicia on the reel, changing the angular orientation of the indicium 205 in a different plane to the spinning of the reel. In this embodiment, the reels 206 stop and the indicia 205 may continue spinning, slowing to a stop at a randomly determined angular orientation.

The video display 210 may also have a video representation of wagering meters to provide wagering information to the player. The meter display may include a credit meter 212 (displays total credits available for wagering), total bet meter 214 (displays the number of credits bet on each game), and a paid credit meter 216 (displays payoff credits obtained from a winning game outcome).

In some embodiments, the player may make wagering selections using a pushbutton panel 220. For example, the player may designate the amount wagered on each individual game (e.g., the bet one pushbutton 227 and the bet max pushbutton 228), the start of the game (e.g., the game start pushbutton 222), and the collection of credits on the gaming machine (e.g., using the collect pushbutton 226).

The pushbutton panel 220 may also be used by the player to make game play decisions. For example, a respin pushbutton 224 may be available to allow the player to cause the video gaming machine 200 to randomly change the angular orientation of each indicium in its array position.

The video display 210 may operate, in some embodiments, in conjunction with a touch screen 230. To facilitate the play of a plurality of different games on a single video gaming machine 200, the touch screen 230 may serve as a means for inputting player selections. Icons representing various potential player selections may be presented on the video display 210. The player may touch an icon presented on the video display 210 to implement the corresponding function represented by the icon. In one embodiment the touch screen 230 may be used exclusively to control game play, eliminating the need for a pushbutton panel 220. In other embodiments, a combination of the pushbutton panel 220 and the touch screen 230 may be used to execute the player's game play decisions.

In addition, the video gaming machine 200 may provide sound effects or music to accompany game play through speakers 270. The speakers 270 may also provide game play information (e.g., player audio help).

Figure 3:
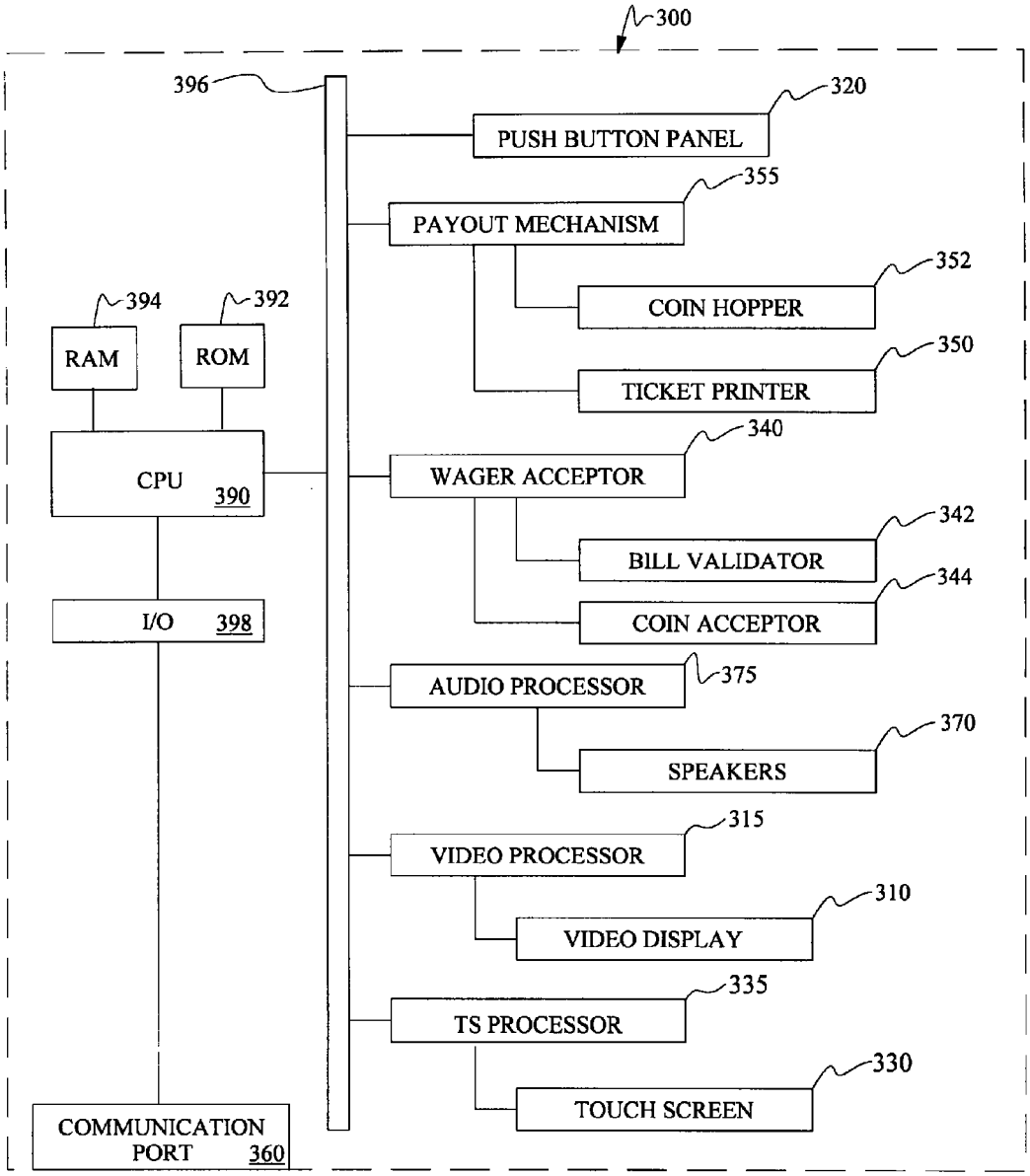
FIG. 3 is an exemplary block diagram of one embodiment of the control system of the gaming machine of FIG. 2.

With reference to FIG. 3, an exemplary control block diagram 300 is provided depicting the operational control of one embodiment of the video gaming machine 200 illustrated in FIG. 2. The central processing unit (i.e., CPU) 390, among other functions, controls the operation of peripheral devices ancillary to the operation of the gaming machine through the execution of the game program.

The CPU 390 has an internal I/O bus 396 to control communications between the CPU and the peripheral devices. The CPU 390 generally controls, either directly or indirectly: the bill validator 342 and coin acceptor 344 (more generally known as wager acceptors 340), the video display 310 (output controlled by video processor 315), the pushbutton panel 320, the coin hopper 352 and ticket printer 350 (more generally known as payout mechanisms 355), speakers 370 (output controlled by audio processor 375), and the touch screen 330 (input monitored by touch screen processor 335).

The CPU 390 not only controls and communicates with peripheral devices inside the gaming machine, but is also in communication with various servers that provide ancillary support services through a communication network as previously discussed. Typically, the CPU 390 also has a second, external I/O bus 398 that exchanges data with the communication network through a communication port 360 in the gaming machine.

In addition to controlling each of the gaming machine's peripheral devices, the CPU 390, through the execution of the game program, also controls game play. The gaming machine has non-volatile, read-only memory (ROM) 392, in which the game program is stored. In addition, the gaming machine has volatile, random access memory (RAM) 394 from which the game program is executed with the CPU 390.

The game play of the wagering game is typically determined by the CPU 390, which signals the video processor 315 to display an image on the video display 310. In one embodiment, the CPU 390 randomly selects indicia from an indicia set (e.g., from a probability table) by generating a random number with a random number generator (not shown). The random number generator is a mathematical operation executed by the CPU using an initial numeric seed to determine a random number within a predetermined numerical range. The random number determined corresponds to an indicium (or, in another embodiment, with an entire game outcome) listed in a probability table stored in memory, which is then assigned to the game array. With this general background of gaming machine operation, the process for executing the wagering game will now be described.

Figure 4:
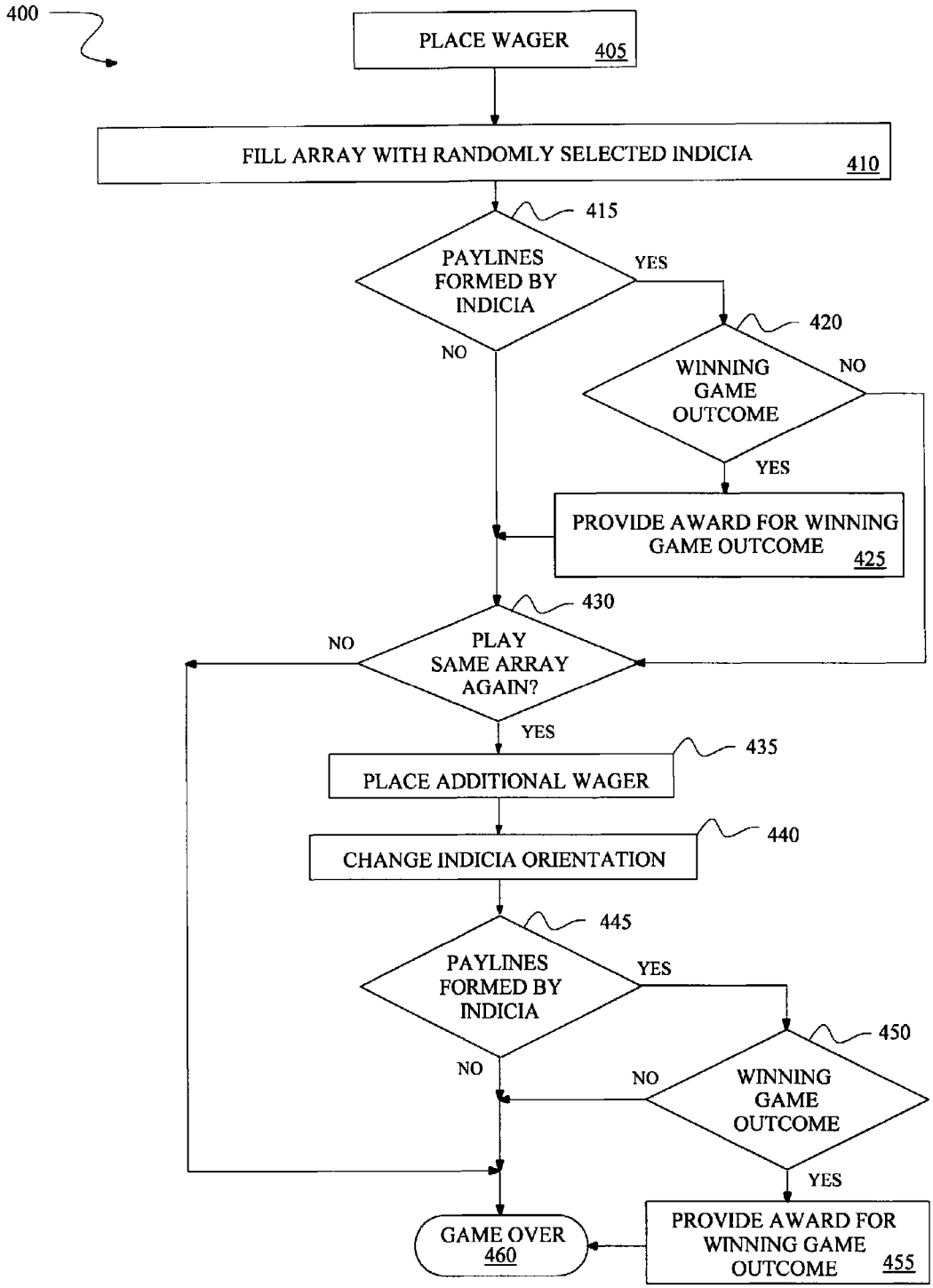
FIG. 4 is an exemplary process flowchart illustrating the game play of one embodiment of the wagering game.

Referring to FIG. 4, the process flowchart 400 provides an overview of one embodiment of the wagering game process. As is generally the case in most slot type gaming machines, the wagering game starts with recognizing a wager in step 405. The gaming machine then forms an array with randomly selected indicia in step 410 with a random number generator in conjunction with an indicia probability table.

Figure 12:
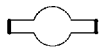
FIG. 12 is an exemplary indicia probability table for randomly determining an indicium for an array position in one embodiment of the wagering game.
Figure 12:
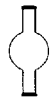
Figure 12:
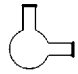
Figure 12:
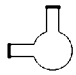
Figure 12:
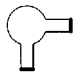
Figure 12:
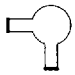
Figure 12:
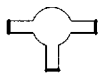
Figure 12:
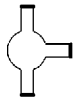
Figure 12:
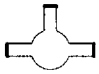
Figure 12:
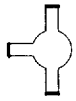
Figure 12:
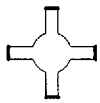

Referring to FIG. 12, an exemplary indicia probability table 1200 is illustrated which, in one embodiment, is used to individually select each indicium in the array. Each different indicium type 1220 (i.e., as identified by the number of members associated with the indicium) is represented on the indicia probability table 1200 in each of their potential angular orientations relative to the array.

In addition to indicium types distinguishable by the number of members associated with each indicium, in one embodiment, there are also indicium subtypes identifiable by the relative orientation of the members on the indicium. For example, in the embodiment of FIG. 12, a two-member indicium type may have two different subtypes: one indicium subtype having members at 180 degrees apart and another indicium subtype with members 90 degrees apart. In some embodiments, these two different subtypes are not considered equivalent or otherwise interchangeable for purposes of producing a winning game outcome. In other embodiments, these two indicia subtypes may be considered equivalent for purposes of determining an award amount.

In this embodiment, a random number 1210 for each array position is generated to determine each indicium type 1220 in the game array. A random number generator (not shown) determines a random number 1210 within a given range (in this case, between zero and ten inclusive). The random number 1210 generated acts as an index into the probability table 1200, allowing the determination of a corresponding indicium type 1220. The corresponding indicium type 1220 determined by the random number is then assigned to the array position for which the random number was generated.

As a result, the random number generator in conjunction with the probability table of FIG. 12 selects any one of the possible indicia in any of their possible angular orientations, producing a randomly selected indicium with a random angular orientation. This process may be repeated for each of the array positions until the array is filled.

In another embodiment, the indicia probability table 1200 may be weighted by specifying a range of random numbers (not shown) for each of the corresponding indicium types 1220 illustrated in the indicia probability table 1200. The range of random numbers for each of the indicia types 1220 may vary to increase the probability of selecting specific indicia.

In step 415, the gaming machine determines whether the randomly selected indicia in the array form paylines. As previously noted, in one embodiment, paylines are formed by indicia linking together which meet one or more payline construction conditions. In another embodiment, the mere linkage of indicia creates a subset of indicia potentially eligible for an award; no other conditions are required to be met. In still another embodiment, separate, unlinked groups of linked indicia may all be considered to determine a game outcome, either separately or together.

Linking indicia are pairs of indicia which identify each other (mutually identify) by, in one embodiment, the alignment of members on each of the pair of indicia (i.e., mutually identify directionally). A single indicium, in some embodiments may link with multiple indicia. Several pairs of indicia may link together to form a chain of indicia which may form a payline. In one embodiment, indicia in the array only link with adjacent indicia.

In one embodiment, adjacent indicia may include all indicia in array positions directly orthogonal to the array position of the indicium. In another embodiment, adjacent indicia may also include indicia in array positions directly diagonal to the array position of the indicium. Alternatively, adjacent indicia may only include indicia in positions directly diagonal to the array position of the indicium. In more general terms, in one embodiment, adjacent indicia include any indicia to which an indicium could potentially link given the appropriate indicium geometry and orientation.

For embodiments of the wagering game with paylines, the identification of indicia developed paylines may be done in a number of different ways. One approach for identifying paylines in the array is to first search the array for linking indicia and then determine if the linking indicia meet the conditions requisite for forming a payline.

The formation of paylines may be limited, in one embodiment, based on payline construction conditions defining the geometry of valid paylines. For example, conditions may limit the array positions available for forming the payline. In other embodiments, conditions may exist limiting the indicia available for forming the payline. Consequently, the exact methodology used to identify paylines is dependent on the conditions imposed by the wagering game for the formation of paylines.

For example, as noted above, it may be a requirement that all paylines enter and exit from the left and right sides of the array. For this condition, each of the array positions comprising the first column is individually analyzed for the presence of an indicium with a left extending member creating an entry point into the array. Once an indicium in the first column is identified as having an extending member, each possible subsequent branch formed with linking adjacent indicia must then be investigated to determine if a payline can be made to extend across the array to an array position in the third column of the array. If the payline does extend across to the third column of the array, the indicium in that third column array position must have a right extending member to exit the array per the conditions imposed for payline construction in this embodiment If a payline is formed, the indicia designated by the payline are evaluated for winning indicia combinations in step 420. In one embodiment, winning game outcomes require specific combinations of indicia (i.e., indicium type combinations) which are typically listed in a pay table. In some embodiments, winning game outcomes may also require a specific sequence of indicia on the payline.

In still other embodiments, the indicia may have associated symbols. These symbols, in one embodiment, may be the typical slot type symbols traditionally used in slot machine games (e.g., such as cherries, grapes, watermelons, card suits, etc.). The symbols associated with the indicia designated by the payline determine a symbol combination which may be evaluated for winning symbol combinations in step 420. The award for such a winning indicia combination or, more specifically, a winning symbol combination, may then be determined from a pay table in step 425.

Regardless of the formation of a payline in step 415, in this embodiment, the player is given the opportunity to respin the same array with the same indicia in step 430. Respinning changes the angular orientation of an indicium while maintaining its original array position. In some embodiments, the respin may be applied to all indicia in the array or, in other embodiments, to less than all the indicia. The player, the machine, or both the player and the machine may determine the specific indicia to respin. The respin process provides the potential for the indicia to form new connections (i.e., links) and consequently, the potential for forming new paylines with winning game outcomes.

In this embodiment, the only difference in the array as a result of the respin (should the player opt to replay the same array) is that the angular orientation of each indicium in its original array position is changed. Should the player decide not to play the same array again in step 430, the game is over in step 460.

In order to respin the array, in one embodiment, the player must place an additional wager in step 435. In this embodiment, the player is given the opportunity to weigh the probability of the array producing additional winning game outcomes from the respin before placing the additional wager. The appeal of the respin feature is that the player can selectively wager on those gaming arrays having the greatest potential for producing winning game outcomes. Consequently, the player may be limited to only one respin of the array to maintain the payback percentage of the game at a reasonable level.

In another embodiment, the player may be allowed to make additional wagers until a winning game outcome is achieved from the respin. In still another embodiment, the additional wager in step 435 may be waived if no paylines were formed in the original array.

In step 440, the angular orientation of each of the indicia in the array is randomly changed. The change in orientation of each of the indicia is randomly determined with a random number generator in conjunction with an angular change probability table.

Referring to FIG. 13, an exemplary embodiment of an angular change probability table 1300 is illustrated. In one embodiment, a random number 1310 is generated for each array position. This random number is used as an index into the table 1300 for the determination of the corresponding angular orientation change 1320 for the indicium. In this embodiment, the angular change probability table 1300 will randomly determine a change in angular orientation of the indicium of 0, 90, 180, or 270 degrees.

Referring back to FIG. 4, in step 445, the respun array is evaluated to identify new paylines formed by the angular reorientation of the indicia. If a payline is formed, the indicia on the payline are evaluated (including any symbols associated with the indicia) to determine whether those indicia form a winning game outcome in step 450. If winning indicia combinations are found, an award is provided for the winning game outcome in step 455 and the game is then over in step 460. If paylines are not formed in step 445, the game is over in step 460.

The embodiment described by the process flowchart of FIG. 4 is but one embodiment of the wagering game. Other embodiments include, for example, the same process described in FIG. 4 without the option of respinning the array as provided in step 430. Instead, the game is over after step 425 and a new game can then be commenced with an entirely new array of randomly selected indicia.

Figure 5A:
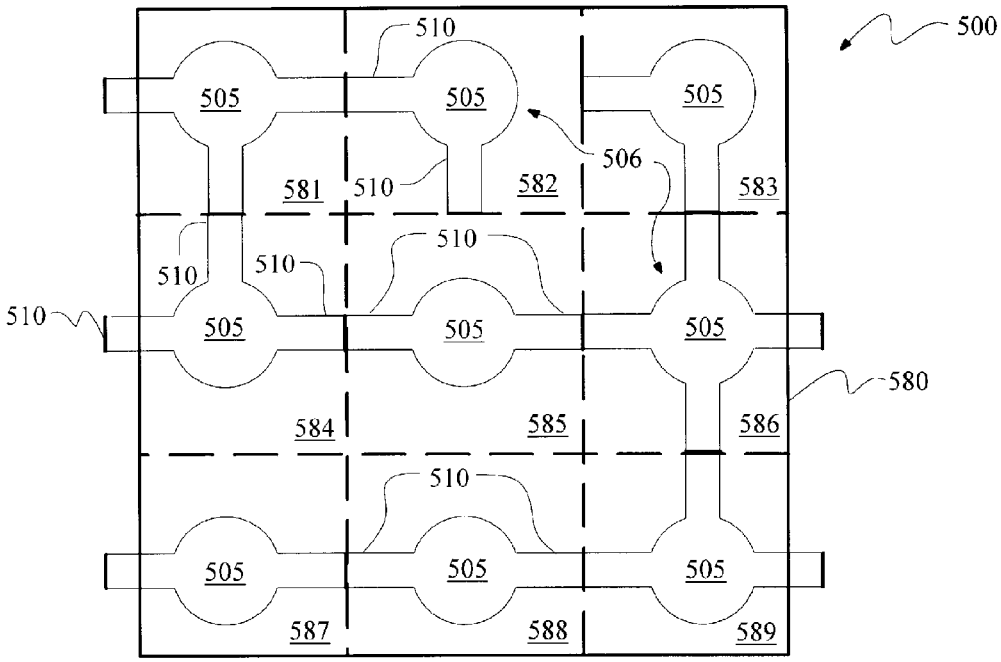
FIG. 5A is an exemplary game outcome of one embodiment of the wagering game.

Turning to FIG. 5A through FIG. 5F, an exemplary wagering game 500 progressively illustrates the paylines developed by the indicia. This wagering game 500 generally follows the game play process depicted by the flowchart 400 of FIG. 4. Referring to FIG. 5A, the wagering game 500 is depicted with a random selection of indicia 505 in a plurality of array positions 581 through 589 in an array 580. The indicia filling the array could be randomly selected from the indicia probability table of FIG. 12.

Each indicium in this embodiment can be grouped with other like indicia (i.e., indicium types) on the basis of indicium geometry characteristics, including: 1) the number of members 510 associated with an indicium, and 2) the relative angular position between the members of the indicium. The angular position of the indicium relative to its position in the array, however, is not related to indicium type in this embodiment. For example, the indicium in array position 585 has two members 510. Likewise, the indicium in array position 582 also has two members. However, the indicium in array position 582 has a 90-degree angle between its two members 510, in contrast to the indicium in array position 585 which has a 180-degree angle between its two members. In this embodiment, these indicia are considered to be two different indicium types for purposes of receiving an award from the pay table. In other embodiments, only the number of members 510 determines like or equivalent indicia (i.e., indicium type).

In the embodiment illustrated in FIG. 5A, the linking of indicia 505 requires a member 510 from each of two indicia to cooperatively indicate a link by aligning the members between the indicia. For example, the indicia 505 in array positions 581 and 582 link (mutually identify) through the alignment of members 510 on each of the indicia (i.e., the indicia pair mutually, directionally identify).

In this embodiment, the indicium in each of the array positions may only link with adjacent indicia located in array positions orthogonal to the array position of a given indicium. For example, any indicium in array position 583 can only potentially link with indicia in array positions 582 and 586 (i.e., adjacent indicia). Another example is the indicium in array position 585 which can only potentially link with indicia in array positions 582, 584, 586, and 588 (adjacent indicia to the indicium in array position 585).

Paylines may be formed by the continuous linking of indicia (i.e., indicia linking together) horizontally across the array to form an entry and exit at the vertical boundaries of the array. Paylines extending from left to right in the array may travel vertically in a column with appropriately aligned members connecting indicia until further appropriately aligned members connecting indicia extending horizontally can continue travel of the payline. In this embodiment (illustrated in FIG. 5), as one of the payline construction rules, the payline may not backtrack (i.e., reverse direction) in either the rows or the columns of the array.

In addition, in this embodiment, paylines may also be formed by the continuous linking of indicia to achieve an entry and exit at the horizontal boundaries of the array. A plurality of indicia in the rows may be used to help make this continuous, vertical connection. Similar to the development of the horizontal paylines described above, paylines extending vertically may not backtrack in either the rows or the columns of the array.

It is a further payline construction condition of this embodiment of the wagering game 500 that the payline must enter and exit the array 580. The entry and exit from the array 580 are indicated by the same member 510 associated with indicia 505 used to indicate a partial linking connection with adjacent indicia. In one embodiment, only a single member 510 from an indicium 505 is required to indicate entry or exit from the array 580 (e.g., by extending a member from the array).

For example, referring to FIG. 5A, in array position 584, a member 510 associated with an indicium 505 extends to the left entering/exiting the array 580. In array position 586, a member 510 associated with an indicium 505 extends to the right entering/exiting the array 580. In this embodiment, the indicium in array position 584 and array position 586 are a first indicium and last indicium, marking the start and finish of the indicia developed payline. All of the linking indicia between the first indicium and the last indicium, in this embodiment, are considered part of the payline.

Depending upon the embodiment, either array position may be considered the first and last indicium of the payline. In other embodiments, however, winning indicia combinations may require a continuous sequence of predetermined indicia. These indicia and their sequence may require development from left to right, right to left, or from either left to right or right to left to obtain a winning game outcome depending on the embodiment.

The entry or exit indication does not require, in some embodiments, the extending member of the indicium to cross an array boundary. Instead, the indication for some embodiments only requires the member of the indicium to extend away from the array or in a specified direction. In one embodiment, exiting or entering the array may be equivalent with extending from the array. Extending from the array, in one embodiment, may be defined as any member of an indicium without an adjacent indicium.

Figure 5B:
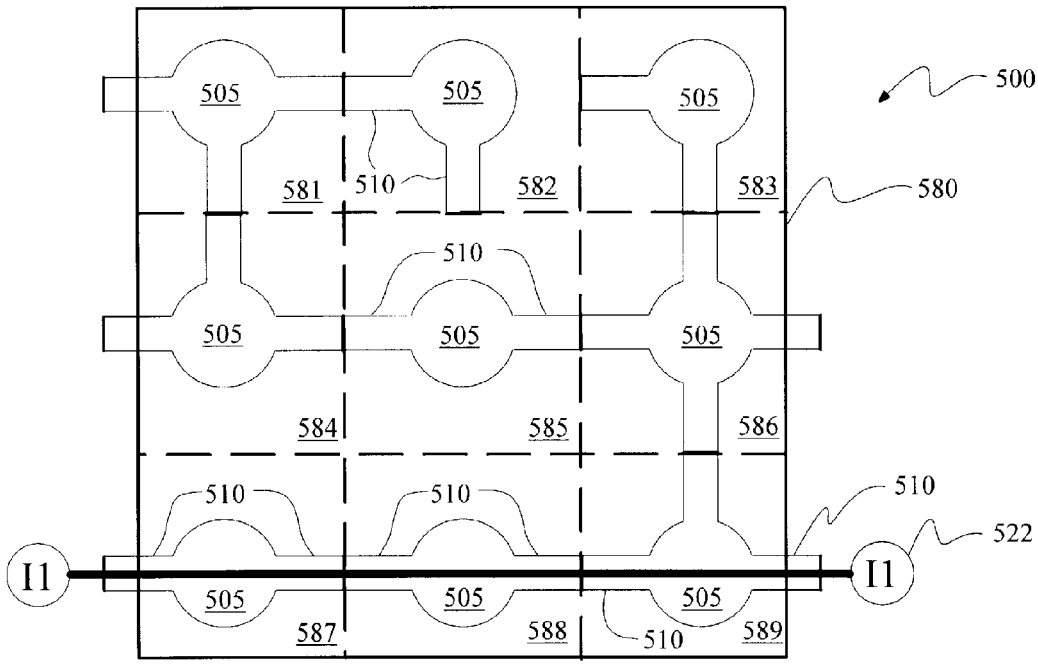
FIG. 5B is the exemplary game outcome of FIG. 5A illustrating a first indicia developed payline.

Turning to FIG. 5B and applying the above described payline construction conditions, the wagering game 500 has identified a first indicia developed payline 522 created by the indicia 505 in array positions 587, 588, and 589 (linking indicia). In accordance with the payline construction conditions, indicium 505 in array position 587 has a member 510 entering the array 580. Similarly, the indicia 505 in array position 589 has a member 510 exiting the array 580. Furthermore, the members 510 link together the indicia 505 in array positions 587, 588, and 589 to form a subset of indicia. Consequently, the payline 522 in FIG. 5B may receive an award if the indicia in array positions 587, 588, and 589 designated by the payline form a winning indicia combination.

Figure 5C:
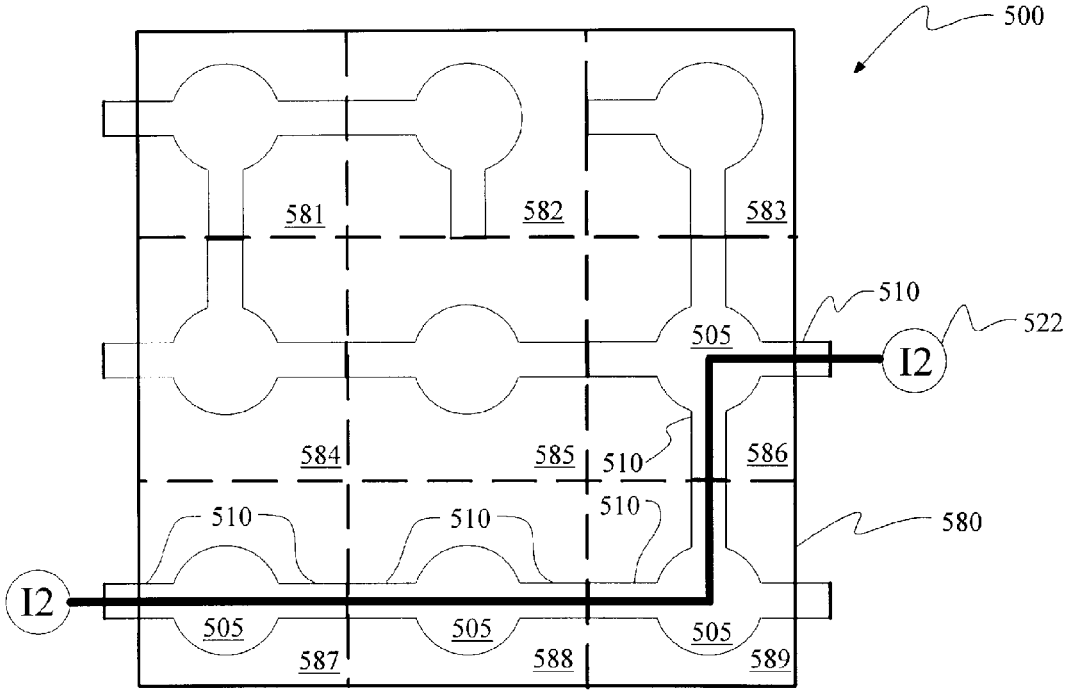
FIG. 5C is the exemplary game outcome of FIG. 5A illustrating a second indicia developed payline.

Turning to FIG. 5C, another payline 522 has been identified by the wagering game 500 developed by indicia 505 in array positions 587, 588, 589, and 586 (linking indicia). Again, each of the indicia 505 in array positions 587 and 586 have members 510 indicating an entry and exit point for the payline 522 from the array 580. Furthermore, the members 510 link together the indicia 505 in array positions 587, 588, 589, and 586 to form a subset of indicia. Consequently the payline 522 in FIG. 5C may receive an award if the indicia in array positions 587, 588, 589, and 586 designated by the payline forms a winning indicia combination.

It should be noted that FIG. 5B and FIG. 5C each have similar paylines. Both use the indicia in array positions 587, 588, and 589. However, FIG. 5C extends the payline of FIG. 5B with the indicium in array position 586. Consequently, the wagering game may, in one embodiment, identify all possible paylines satisfying the required payline construction conditions, regardless of other indicia linking with the subset of indicia identified. In this embodiment, these other indicia, linking with identified subsets of indicia, are ignored for the purposes of determining an award for the identified subset of indicia.

For example, in FIG. 5B, the indicium in array position 586, although it could be linked to the other indicia in array positions 587, 588, and 589; is ignored for the purposes of determining a winning game outcome for payline I1. Payline I2, depicted in FIG. 5C, is also identified for a possible winning game outcome in this embodiment. Thus, in one embodiment, the wagering game maximizes the identification of paylines in the array which satisfy payline construction conditions without regard to unnecessary indicia linking to the identified subset of indicia.

In other embodiments, only one winning game outcome may be identified based on the subset of indicia formed from all the indicia which can possibly be linked together. In this embodiment, FIG. 5C showing payline I2 would produce a winning game outcome, and payline I1 shown on FIG. 5B would not receive a winning game outcome.

In still other embodiments, an award is only paid for the subset of indicia identified providing the largest award amongst a plurality of identified indicia subsets, all formed from the same group of linking indicia. Consequently, again referring to FIG. 5B and FIG. 5C, the payline with the greater award is paid; or, if the two paylines have the same award, only a single award is made.

Figure 5D:
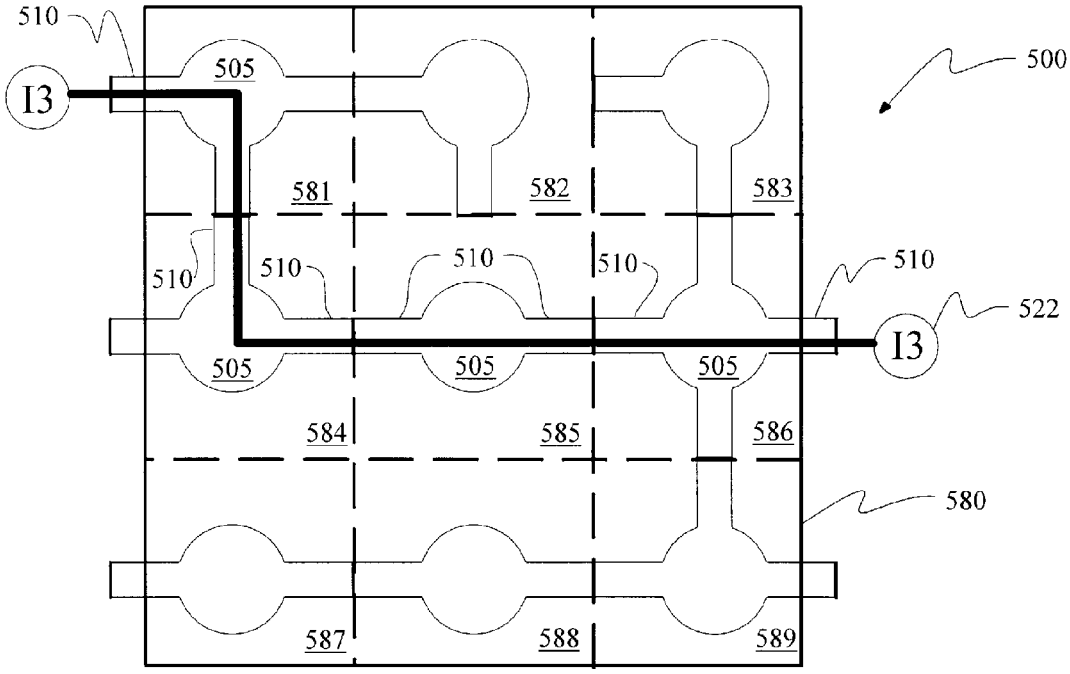
FIG. 5D is the exemplary game outcome of FIG. 5A illustrating a third indicia developed payline.

Turning to FIG. 5D, another payline 522 has been identified by the wagering game 500 created by indicia 505 in array positions 581, 584, 585, and 586 (linking indicia). Indicia 505 in array positions 581 and 586 have members aligned to provide an entry and exit point for payline 522 from the array 580. Furthermore, the members 510 link together the indicia 505 in array positions 581, 584, 585, and 586 to form a subset of indicia. Consequently the payline 522 in FIG. 5D may receive an award if the indicia in array positions 581, 584, 585, and 586 designated by the payline forms a winning indicia combination.

Figure 5E:
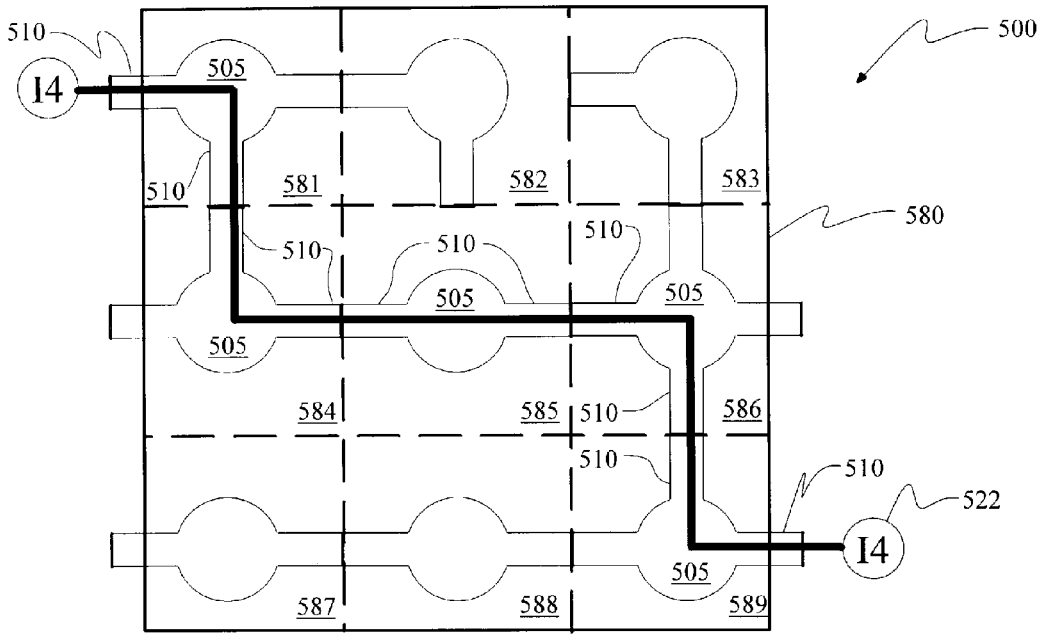
FIG. 5E is the exemplary game outcome of FIG. 5A illustrating a fourth indicia developed payline.

Turning to FIG. 5E, another payline 522 has been identified by the wagering game 500 developed by indicia 505 in array positions 581, 584, 585, 586, and 589 (linking indicia). Again, indicia 505 in array positions 581 and 589 have members 510 aligned to provide an entry and exit point from the array 580. Furthermore, the members 510 link together the indicia 505 in array positions 581, 584, 585, 586 and 589 to form a subset of indicia. Consequently the payline 522 in FIG. 5E may receive an award if the indicia in array positions 581, 584, 585, 586, and 589 designated by the payline forms a winning indicia combination.

Once the paylines have been identified (as shown in FIG. 5B-FIG. 5E), each individual payline can be assessed for a winning game outcome. The wagering game 500 illustrated in FIG. 5 has four different indicia developed paylines 522. Each of these indicia developed paylines 522 is potentially eligible for an award depending on the indicia 505 designated by the payline. Indicia combinations forming a winning game outcome and the award associated with that winning game outcome is generally contained in a pay table for the wagering game.

Figure 5F:
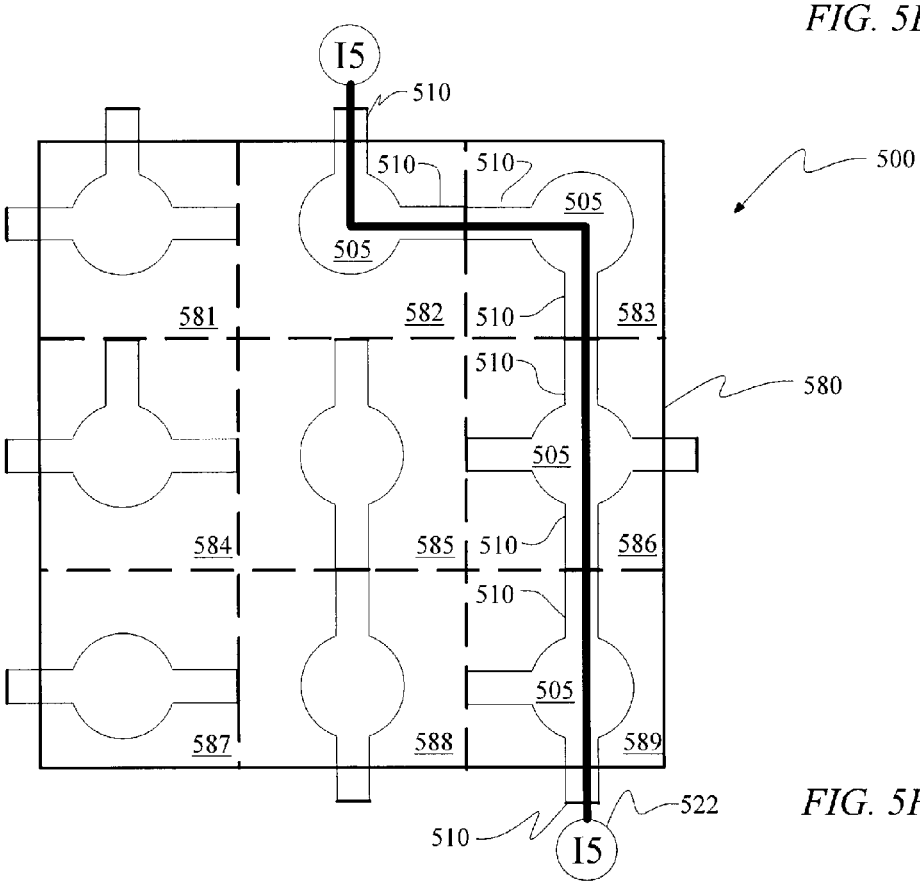
FIG. 5F is an exemplary game outcome received from the random angular reorientation of the indicia in the array depicted in FIG. 5A.
Figure 6:
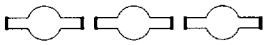
FIG. 6 is an exemplary pay table for the exemplary wagering game embodiment of FIG. 5.
Figure 6:
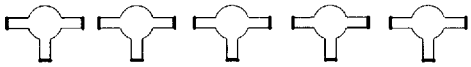
Figure 6:
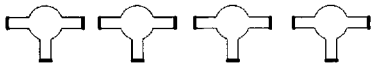
Figure 6:
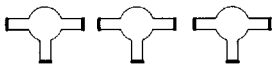
Figure 6:
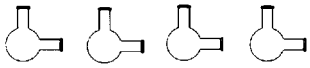
Figure 6:
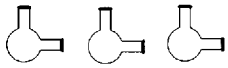
Figure 6:
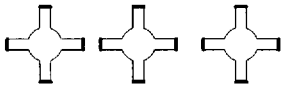

Referring to FIG. 6, an exemplary pay table 600 for the wagering game 500 embodiment illustrated in FIG. 5 is provided. The pay table 600 of FIG. 6 makes an award 620 based on the winning indicia combination 610 formed by the indicia on the payline, irrespective of the position of the indicia on the payline in this embodiment. The award in this embodiment is in credits, which can be converted to cash when the player cashes out of the gaming machine.

The indicium type (as determined by the number of members on each indicium and the relative position of the members) of each of the indicia on the payline determines whether the payline has a winning indicia combination 610 and a winning game outcome. In addition, the probability of forming the payline is, in this embodiment, taken into account in the determination of the award 620 listed in the pay table 600.

For the wagering game 500 embodiment exemplified by FIG. 5, one of the payline construction conditions, in this embodiment, is that the payline may not backtrack in any direction (i.e., reversing direction is not permitted). By inspection, the longest possible payline potentially available in this wagering game 500 is a link of five indicia exemplified by the illustration of FIG. 5E. The shortest payline is a link of three indicia exemplified by the illustration of FIG. 5B. Consequently, a payline with a winning game outcome could potentially include three, four, or five identical indicia.

Pay table 600 lists winning indicia combinations having up to five identical indicia. A minimum of three identical indicia are required to achieve a winning game outcome. These identical indicia may occur on the payline in any order. This type of winning game outcome is similar to a "scatter" pay of a traditional slot type game. It should be noted, in this embodiment, the angular orientation of the indicia is irrelevant to the determination of a winning game outcome and to any possible award. The orientation of the indicia is only relevant to the creation of paylines in this embodiment.

In another embodiment, if desired, three consecutively positioned indicia may pay more than three indicia that are not consecutively positioned from left to right on the payline or right to left. Furthermore, in still another embodiment, a winning game outcome having indicia with the same angular orientation may provide a larger award than the same number of identical indicia having different angular orientations.

Applying this pay table 600 to the exemplary wagering game 500 embodiment illustrated in FIG. 5, it is apparent that the only winning game outcome occurs on the payline 522 shown in FIG. 5E. The remaining paylines depicted in FIG. 5 do not have the three or more identical indicia required for a winning game outcome.

The indicia developed payline 522 of FIG. 5E designates five array positions, with three array positions having identical three-member indicia occurring in array positions 581, 584, and 589. Although these indicia do not occur consecutively across the payline, they are eligible for an award. Referring back to FIG. 6, as can be seen from pay table 600, an award 620 of three credits is paid for this winning indicia combination 610. Consequently, the player has won three credits for this array.

Returning to the exemplary wagering game 500 embodiment depicted in FIG. 5 (and following the flowchart 400 embodiment illustrated in FIG. 4), the player now has the opportunity to place an additional wager to respin (randomly change the angular orientation) each indicium in its original array position. In some embodiments, the original angular orientation of an indicium may be randomly selected again, maintaining the same relative angular orientation in the array.

With the respin game play mechanic, a player is given the opportunity to strategically assess the probability of obtaining winning game outcomes from the random angular reorientation of the indicia. To assist the player in assessing the probability of success with a respin, the indicia may be colorized, in one embodiment, to help the player quickly assess the strength of the indicia in the array. For example, indicia having four members may be colored green, indicia having three members may be colored blue, indicia having two members may be colored yellow, and indicia having no members may be colored red (e.g., depicted as a circle with which no indicia can link with). Respinning an array having substantially all green and blue indicia would have a higher probability of producing a winning game outcome than an array substantially filled with red and yellow indicia.

In another embodiment, rather than colorizing the indicia, a specific symbol may be used for each indicium type to indicate the number of members on that indicium type. For example, a card rank may be used to indicate the number of members on each indicium type. A four-member indicium might have an Ace symbol, a three-member indicium a King symbol, and a two-member indicium a Queen symbol. Having a symbol on each different indicium type, in certain embodiments, may assist the player's rapid recognition of winning game outcomes and the overall strategic standing of the array. Rather than counting the members on each of the indicia on a payline, the player can focus on the symbols displayed on each of the indicia. In this embodiment, the pay table may indicate the symbols as receiving the award; however, each specific symbol can only be assigned to a particular indicium type (i.e., an indicium with a specific number of members). Consequently, the winning indicia combination is still determined by the number of members on each of the indicia on the payline.

Although winning indicia combinations are determined by the number of identical indicia in the pay table embodiment depicted in FIG. 6, in other embodiments, winning indicia combinations may include combinations of differing types of indicia. For example, similar to a Poker type game, a winning indicia combination could include three identical indicia in combination with two other identical indicia to make the equivalent of a Full House in Poker. Another winning game outcome, in this embodiment, could include two pairs, each pair having identical indicia forming the equivalent of two pairs in a Poker type game.

In still another embodiment, the award for winning payline may be determined based on the total number of members on each of the indicia producing the payline. In one embodiment, a pay table (not shown) listing the minimum number through the maximum number of possible members on indicia forming a payline and each corresponding award is used to determine the award for a payline. In one embodiment, a series of pay tables may be used, each one specifically intended for the length of the payline. For example, in the embodiment illustrated in FIG. 5, a pay table may be created for three indicia, four indicia, and a five indicia payline. In the case of a three indicia pay line, a minimum of six members would be present on each of the indicia (i.e., three, two-member indicia). The maximum number of members on indicia forming a three indicia payline is twelve members (i.e., three, four-member indicia). For example, referring to FIG. 5B, there is a total of seven members on the indicia forming the pay line (I1). The pay table could be entered for a seven member win to determine a corresponding award. The award amount, in one embodiment, corresponds to the probability of forming the payline with a particular indicia combination.

In another embodiment, in lieu of respinning the indicia, the original array may be reformed by placing the original indicia into random array positions with the same angular orientation. Furthermore, the reformed array may also be respun, in one embodiment.

Referring to FIG. 5F, the player has made the additional wager and the angular orientation of the indicia in the array has been randomized (i.e., respun). As a result, a new indicia developed payline 522 has been created from the top to the bottom of the array 580 in array positions 582, 583, 586, and 589. This payline, however, does not contain the minimum requirement of three identical indicia, making it ineligible for an award per the pay table 600 illustrated in FIG. 6.

Although the embodiment illustrated in FIG. 5 has paylines that are similar to left to right and top to bottom paylines found in traditional slot type gaming machines, other embodiments are also available employing less traditional payline geometry. For example, in one embodiment, any path created by connecting indicia that enters and exits the array may be considered a payline and potentially eligible for an award.

Figure 7:
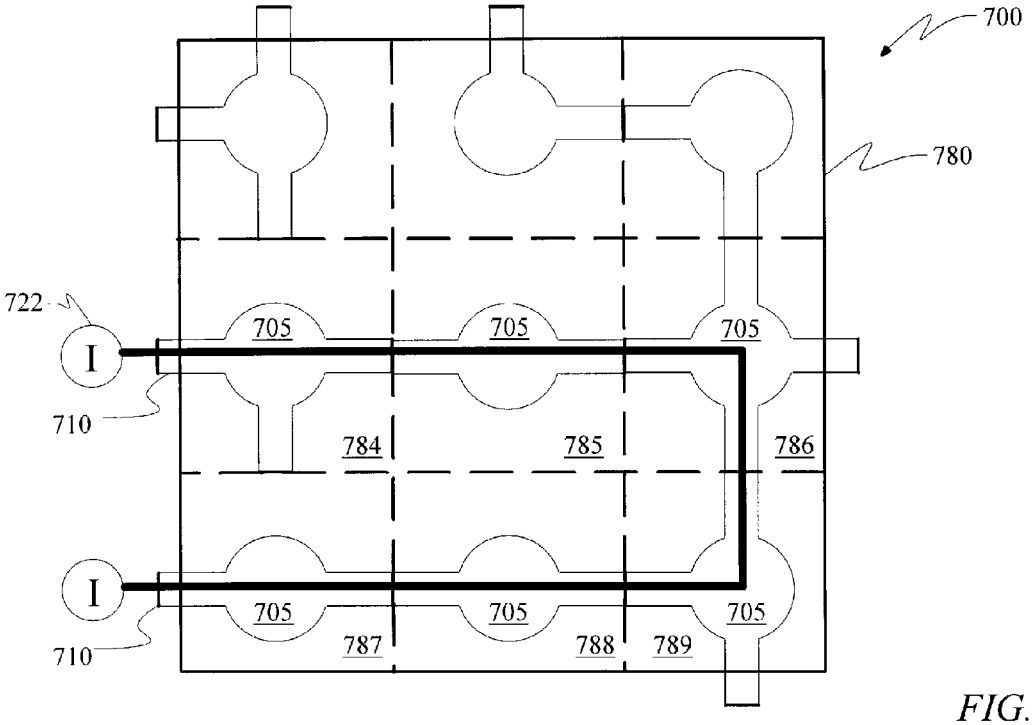
FIG. 7 is an exemplary game outcome illustrating an indicia developed payline entering and exiting the same side of the array.

For example, in FIG. 7, one embodiment of the wagering game 700 is depicted with the randomly selected indicia forming an array 780. The indicia developed payline 722 created by indicia linking together in array positions 784, 785, 786, 789, 788, and 787 enters and exits the same side of the array 780. The indicium in array position 784 includes a member 710 for entering/exiting the array 780, and the indicium in array position in 787 has a member 710 for exiting/entering the array.

Figure 8:
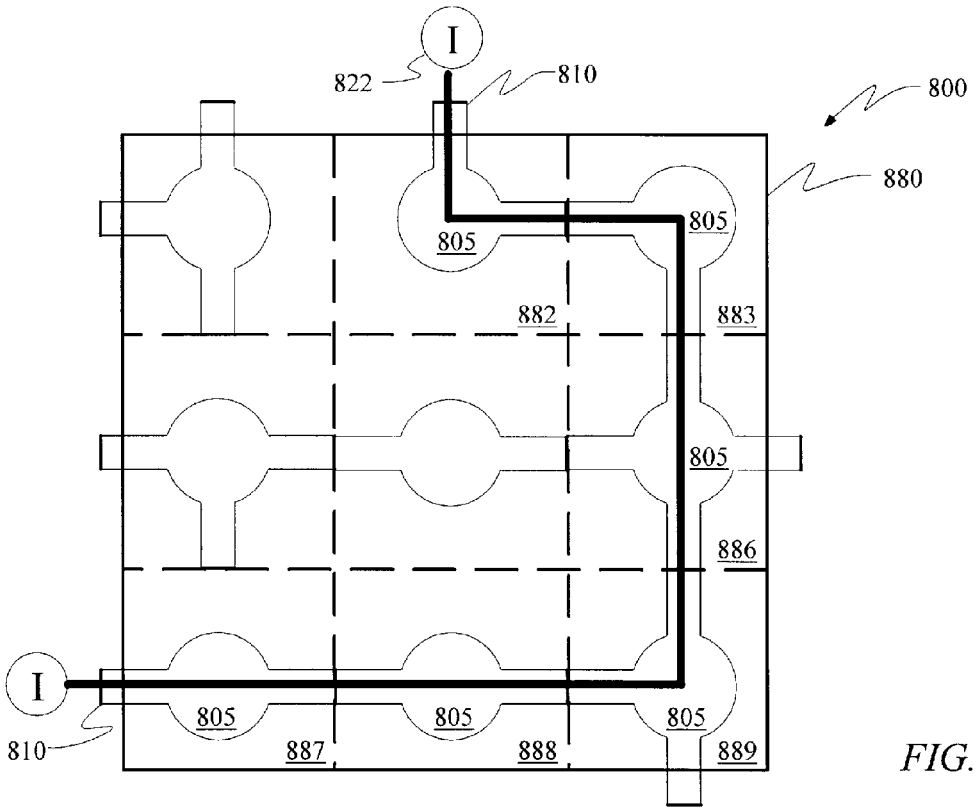
FIG. 8 is an exemplary game outcome illustrating an indicia developed payline entering the side and exiting the top of the array.

Referring to FIG. 8, another non-traditional payline is illustrated in a wagering game 800 having randomly selected indicia forming an array 880. In the embodiment illustrated in FIG. 8, the wagering game 800 has a payline 822 entering the left side of the array 880 and exits at the top of the array 880 through the linked indicia in array positions 887, 888, 889, 886, 883, and 882. The indicium in array position 887 has a member 810 for entering/exiting the array 880, and the indicium in array position 882 has a member 810 for exiting/entering the array.

In the embodiments discussed above, the paylines have an indicium at the start and at the end of the payline having a member entering and exiting the array respectively. In other embodiments, there is no requirement for the payline to have indicia with members entering and exiting the array; the indicia in the subset of indicia must only link together.

Figure 9A:
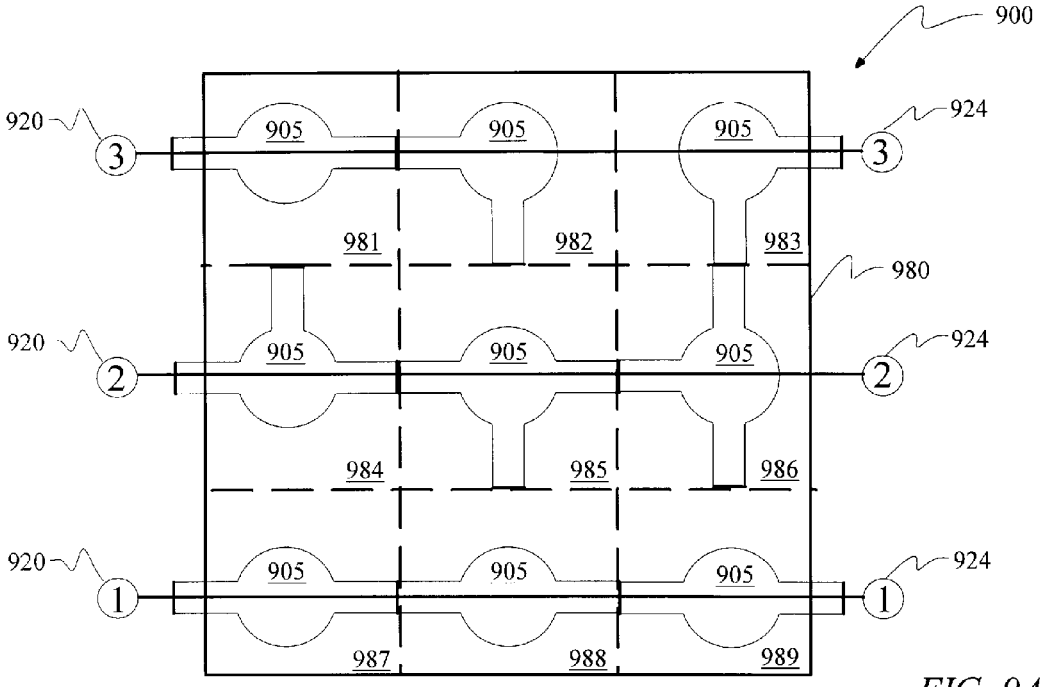
FIG. 9A is an exemplary game outcome for one embodiment of the wagering game having both preset and indicia developed paylines.

Referring to FIG. 9, another embodiment of the wagering game 900 is depicted having an array 980 filled with randomly selected indicia having preset paylines 924. These preset paylines 924 designating predetermined array positions are similar to those on traditional slot type wagering games. The player may wager on the three traditional horizontal preset paylines 924: 1) the first row (array positions 981, 982, and 983); 2) the second row (array positions 984, 985, and 986); and 3) the third row (array positions 987, 988, and 989). In this embodiment, the player makes a wager for each of these three preset paylines 924 and may receive any indicia developed paylines as a bonus for playing the wagering game 900. For simplicity and ease of illustration, the indicia developed payline construction conditions are the same in this embodiment as for the exemplary embodiment of FIG. 5.

Figure 9B:
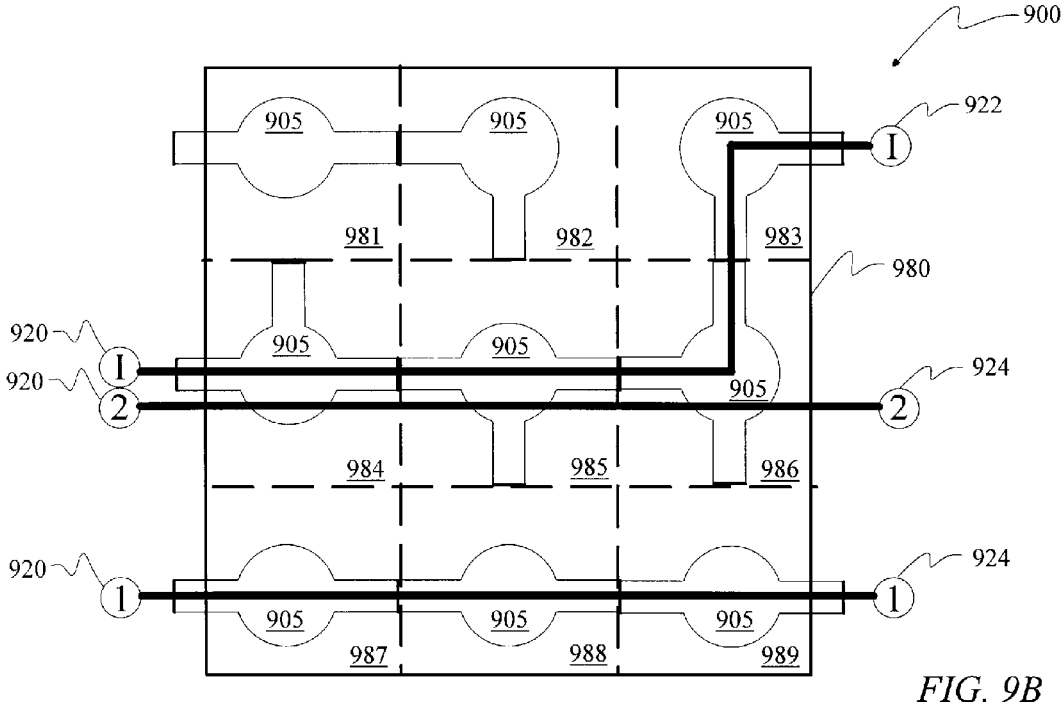
FIG. 9B is the exemplary game outcome of FIG. 9A illustrating a winning indicia developed payline and two winning preset paylines.

Referring to FIG. 9B, the highlighted paylines designate the winning game outcomes. In this exemplary game outcome, the player has received winning game outcomes on two types of paylines 920: 1) the preset paylines 924 through array positions 984, 985, 986 and through array positions 987, 988 and 989; and 2) the two indicia developed paylines 922 formed by indicia in array positions 984, 985, 986, and 983 and array positions 987, 988 and 989. However, in this embodiment, any paylines designating the same array positions are only paid the larger of the two possible awards.

Referring to FIG. 10, another embodiment of an exemplary pay table 1000 is depicted for the wagering game 900 embodiment of FIG. 9. In this exemplary pay table 1000, any payline with three or more indicia of the same indicium type is a winning game outcome as shown by the winning indicia combinations 1010. The indicia developed payline awards 1020 are listed for each of the winning indicia combinations 1010 (the angular orientation is irrelevant to the award). The exemplary pay table 1000 of FIG. 10 also includes preset payline awards 1030 which require three of the same indicium type to receive an award. The preset payline awards 1030 are available in two different types for winning indicia combinations: 1) the same angular orientation award 1032 and 2) different angular orientation award 1034.

Referring back to FIG. 9B, the preset payline 924 designating array positions 984, 985, and 986 includes three, three-member indicia, with different angular orientations. Therefore, referring to FIG. 10, according to the pay table 1000, the winning indicia combination 1010 of three, three-member indicia provides a preset payline award 1030 for indicia with different angular orientations 1034 of two credits.

Referring back to FIG. 9B, the preset payline 924 designating array positions 987, 988, and 989 includes three indicia of the same type in the same angular orientation. Again, referring to FIG. 10, according to the pay table 1000, the winning indicia combination 1010 of three, two-member indicia provides a preset payline award 1030. In this example, because the indicia have the same orientation, the winning indicia combination would receive the same angular orientation award 1032 of three credits. However, as noted above, the three, two-member indicia form an indicia developed payline. In this case the three, two-member indicia forming the payline are eligible to receive an award of five credits. Consequently, the player receives only the larger of the two awards (i.e., five credits) for this payline.

Referring back to FIG. 9B, the indicia developed payline 922 designating array positions 984, 985, 986, and 983 has three indicia of the same type. Referring to FIG. 10, according to the pay table 1000, the winning indicia combination 1010 of three, three-member indicia, provides an indicia developed payline award 1020 of three credits.

Although all the exemplary embodiments described above are indicia with up to four members, other embodiments are possible with indicia having any number of members. For example, in one embodiment, indicia with up to eight indicating members may be positioned at 0, 45, 90, 135, 180, 225, 270, and 315 degrees. This allows indicia developed paylines to be formed not only in orthogonal (i.e., horizontal and/or vertical directions), but also along diagonal lines in the array. In another embodiment, the members of the indicia may be placed at non-uniform, angular intervals.

Diagonal paylines may also be developed by allowing the orthogonal indicia (i.e., indicia with up to four members positioned at 0, 90, 180, and 270 degrees) to stop with members at a 45, 135, 225, or a 315 degree angle—rather than limited to 0, 90, 270, and 360 degree angles (which establish orthogonal paylines as described in the exemplary embodiment of FIG. 5). Similarly, the up to eight-member indicia described above may also be stopped and positioned at multiples of 45 degrees.

Figure 14:
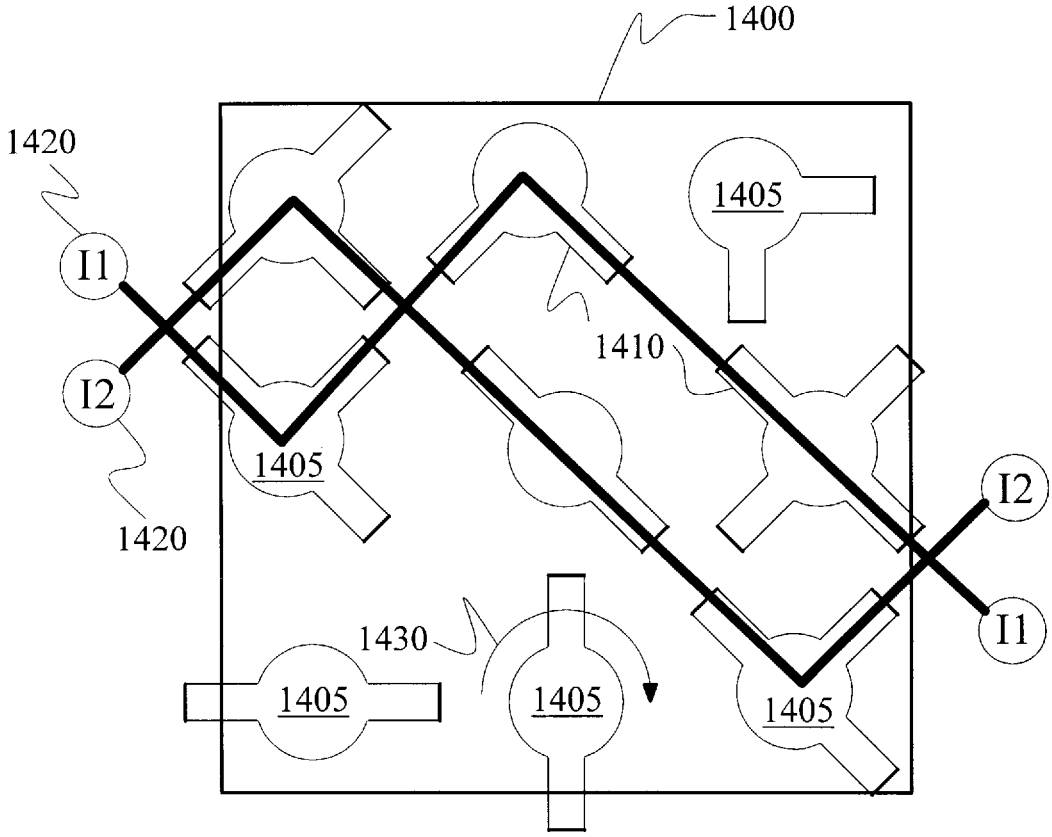
FIG. 14 is an exemplary game outcome for an embodiment of the wagering game having indicia producing diagonally developed paylines.

For example, referring to FIG. 14, an exemplary embodiment of the outcome of a wagering game 1400 is illustrated. The indicia 1405 are allowed to randomly stop their angular rotation (as indicated by arrow 1430) with members 1410 at a 45, 90, 135, 180, 225, 270 or a 315 degree angle. Diagonal paylines 1420 are formed through indicia 1405 with members 1410 in direct alignment.

In still another embodiment, the indicia may have dual (or more) characteristics. For example, an indicium may have both a plurality of members and an associated symbol (e.g., a traditional fruit symbol depicted on the indicium). In this embodiment, the members of the indicia form the payline while the symbols on the indicia forming the payline determine a winning game outcome. Similar to the process described above, the indicia and their associated symbols are, in one embodiment, randomly selected and assigned to the array using a random number generator and a probability table.

Figure 11A:
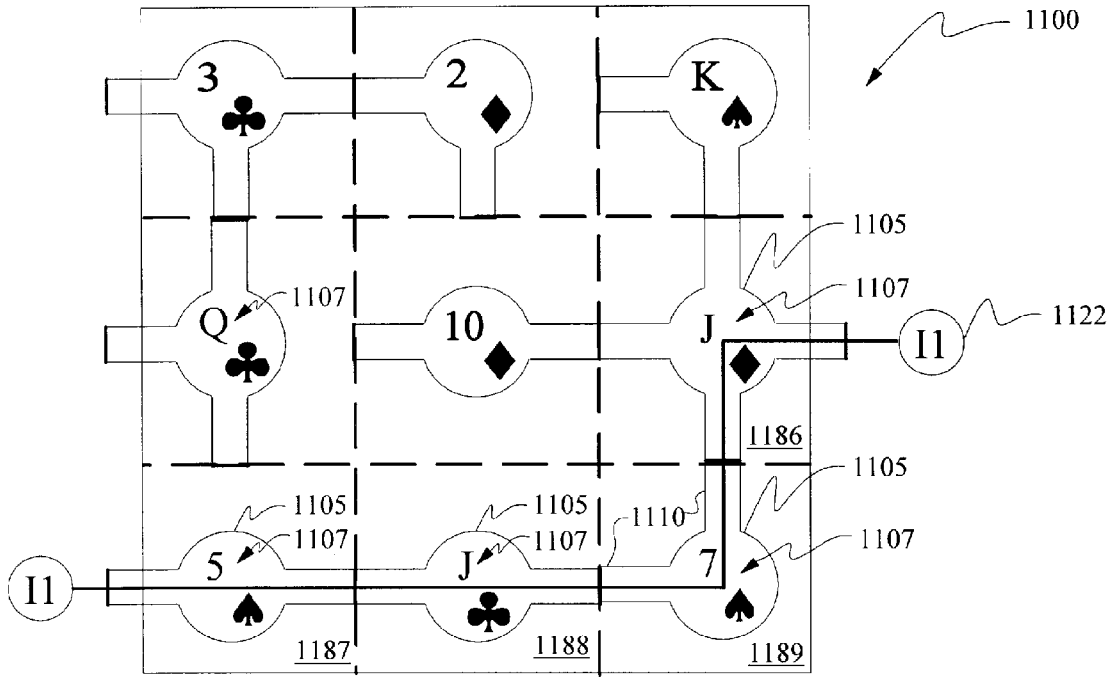
FIG. 11A is an exemplary game outcome for an embodiment of the wagering game having indicia with associated symbols.

Referring to FIG. 11A, an exemplary array is illustrated formed from dual characteristic indicia. The exemplary wagering game 1100 has indicia 1105 with associated symbols 1107. In this embodiment, the symbols are dual characteristic symbols having both a suit and a rank. The indicia 1105 designated by the indicia developed payline 1122 determine the card hand which, in this embodiment, is based on the associated symbols 1107 displayed on each of the designated indicia.

The associated symbol 1107 (or symbols) on each indicium 1105 are distinguishable from the indicium. For example, in array position 1189, the indicium 1105 has two members 1110 and an associated symbol 1107 (the Seven of Spades). Consequently, in this embodiment, the indicia are a combination of a card symbol (e.g., Seven of Spades) to determine a winning game outcome and a number of members 1110 on the indicia for forming paylines.

FIG. 11A illustrates an exemplary game outcome with a winning indicia developed payline 1122. In this wagering game embodiment, the same payline conditions applied to the wagering game embodiment of FIG. 5 have been applied. Consequently, array positions 1187, 1188, 1189, and 1186 form a payline 1122. In this wagering game embodiment, the objective of the game is to form a winning poker hand.

In this wagering game embodiment, similar to the wagering game embodiment payline construction rules illustrated in FIG. 5, the winning game outcomes may comprise between three and five indicia. Consequently, pay tables may be available for 3, 4, and 5-card poker games. In this exemplary outcome, the player has a Pair of Jacks. The award for such a game outcome may be indexed to a pay table for a four-card poker game (not shown) based on the four indicia comprising the payline 1122.

Figure 11B:
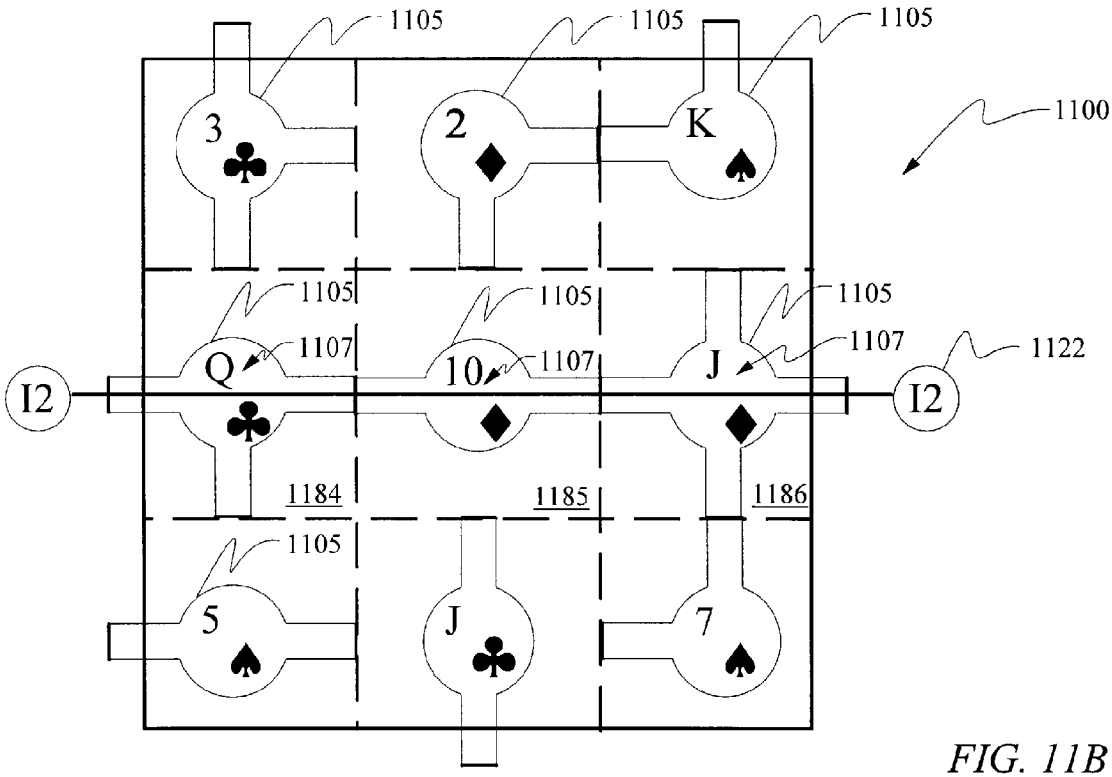
FIG. 11B is an exemplary game outcome received from the random angular reorientation of the indicia in the array depicted in FIG. 11A.

Referring to FIG. 11B, the indicia have been respun while the symbols associated with the indicia remains stationary (for ease of player viewing). As a result of the respin, new paylines have been created. As can be seen from FIG. 11B, a new indicia developed payline 1122 in array positions 1184, 1185, 1186 has been created. A new winning game outcome has been created on this payline comprising the symbols: Queen of Clubs, Ten of Diamonds, and Jack of Diamonds. These symbols create a straight in a typical three-card poker game. Similar to the discussion above, this three-indicium payline could be associated with a three-card Poker pay table.

The wagering games described herein may include a variety of additional game play features. For example, certain indicia may be labeled as wild indicia, allowing that indicium to take on any angular orientation that satisfies the establishment of a winning game outcome. Alternatively, a wild indicium may transform to an indicium having the maximum number of members available for creating linking indicia. For example, a two-member indicium having a wild symbol may transform into a four-member indicium.

In still another embodiment, a winning game outcome may cause the indicia on the payline to be removed and replaced with randomly selected indicia, giving the player a second opportunity for another winning game outcome. In addition, the wagering game described herein could also be played as a non-wagering game.

Other embodiments of this wagering game use different graphical methodologies to indicate subsets of indicia in the array. Any graphical method may be used to convey the identification of a subset of indicia in the array. As illustrated in the above embodiments, one graphical methodology used to indicate linkage between indicia is to align members of adjacent indicia. In one embodiment these members contact. In one embodiment, members on adjacent indicia may be lengthened or shortened, dependent upon the orientation of the member to the adjacent indicia, to make contact and facilitate the player's comprehension of the display. In another embodiment, the members may only require general alignment (i.e., no contact between members).

Other methodologies may also be used to indicate a link between indicia. In one embodiment, any type of indicator associated with the indicium and observable by the player may be used to establish a subset of indicia. The indicator, in one embodiment, may be, for example, a pointer that conveys to the player a subset of indicia in the array. In one embodiment, indicators may be rotated about the indicium and stopped to directionally select adjacent indicia.

Although the exemplary arrays illustrated in the various figures are all three by three arrays, any size array may be used in this wagering game. For example, the array may be rectangular with any number of rows and columns. Furthermore, the arrays need not be rectangular and can be any geometric shape.

While the invention has been illustrated with respect to several specific embodiments, these embodiments are illustrative rather than limiting. Various modifications and additions could be made to each of these embodiments as will be apparent to those skilled in the art. Accordingly, the invention should not be limited by the above description or of the specific embodiments provided as examples. Rather, the invention should be defined only by the following claims.

The invention claimed is:

1. A method of playing a wagering game on a gaming machine, the gaming machine having a processor for executing a game program, comprising:

recognizing a wager to initiate the wagering game;

forming an array with indicia assigned to a plurality of array positions, the indicia randomly selected from a plurality of indicium types, each of the indicium types having a different number of members, the members for directionally identifying adjacent indicia in the array, wherein each of the indicia in the array have an angular orientation which is randomly determined;

presenting the array on a display;

identifying a subset of indicia in the array, wherein each one of the indicia in the subset and at least one other of the indicia in the subset directionally identify each other;

evaluating the subset of indicia for a winning indicia combination, wherein the winning indicia combination is determined by the number of members on each of the indicia in the subset of indicia; and providing an award for the winning indicia combination.

2. The method of claim 1, wherein the subset of indicia includes a first indicium and a last indicium, the first indicium and the last indicium each mutually identify directionally with only one other of the indicia in the subset of indicia.

3. The method of claim 2, wherein one of the members of both the first indicium and the last indicium extend from the array.

4. The method of claim 2, wherein the array has a first column and a last column, the first indicium is assigned to one of the plurality of array positions in the first column and the last indicium is assigned to one of the plurality of array positions in the last column.

5. The method of claim 1, wherein the subset of indicia is limited to the indicia linking from a first indicium to a last indicium, wherein one of the members of both the first indicium and the last indicium extend from the array.

6. The method of claim 1, further comprising changing the angular orientation of at least some of the indicia in the array to form another array.

7. The method of claim 1, wherein each of the indicia in the subset of indicia are linked together.

8. A gaming machine for playing a wagering game, comprising:

a wager acceptor for recognizing a wager;

a video display for displaying the wagering game;

a processor configured for executing a game program operative to:

form an array with indicia assigned to a plurality of array positions, the indicia randomly selected from a plurality of indicium types, each of the indicium types having a different number of members, the members to directionally identify adjacent indicia in the array, wherein the indicia in the array have an angular orientation which is randomly determined;

identify a subset of indicia in the array, wherein each one of the indicia in the subset and at least one other of the indicia in the subset directionally identify each other; and evaluate the subset of indicia for a winning indicia combination, wherein the winning indicia combination is determined by the number of members on each of the indicia in the subset of indicia; and a payout mechanism for providing an award for the winning indicia combination.

9. The gaming machine of claim 8, wherein the subset of indicia includes a first indicium and a last indicium, the first indicium and the last indicium each mutually identify directionally with only one other of the indicia in the subset of indicia.

10. The gaming machine of claim 9, wherein at least one of the members of both the first indicium and the last indicium extend from the array.

11. The gaming machine of claim 8, wherein the subset of indicia is limited to the indicia linking from a first indicium to a last indicium, wherein one of the members of both the first indicium and the last indicium extend from the array.

12. The gaming machine of claim 8, further comprising changing the angular orientation of at least some of the indicia in the array to form another array.

13. The gaming machine of claim 8, wherein each of the indicia in the subset of indicia are linked together.

14. A method of playing a wagering game on a gaming machine, the gaming machine having a processor for executing a game program, comprising:

recognizing a wager to initiate the wagering game;

forming an array with indicia assigned to a plurality of array positions, the indicia randomly selected from a plurality of indicium types, each of the indicium types having a different number of members, the members for directionally identifying adjacent indicia in the array, wherein each of the indicia in the array have an angular orientation which is randomly determined;

presenting the array on a display;

identifying a subset of indicia in the array, wherein each one of the indicia in the subset of indicia and at least one other of the indicia in the subset directionally identify each other;

determining whether the subset of indicia form a payline satisfying a condition;

evaluating the subset of indicia for a winning indicia combination, wherein the winning indicia combination is determined by the number of members on each of the indicia in the subset of indicia; and providing an award for the winning indicia combination.

15. The method of claim 14, wherein the subset of indicia includes a first indicium and a last indicium, the first indicium and the last indicium each mutually identify directionally with only one other of the indicia in the subset of indicia.

16. The method of claim 15, wherein the condition requires at least one of the members of both the first indicium and the last indicium to extend from the array.

17. The method of claim 14, wherein the condition limits the subset of indicia to all the indicia linking from a first indicium to a last indicium, wherein one of the members of both the first indicium and the last indicium extend from the array.

18. The method of claim 14, wherein each of the indicia in the subset of indicia are linked together.

19. The method of claim 14, further comprising changing the angular orientation of at least some of the indicia in the array to form another array.

* * * * *